United States Patent [19]

Cooper

[11] 4,438,947

[45] Mar. 27, 1984

[54] TOE BINDING FOR SKIS

[76] Inventor: Roderick A. Cooper, 4310 Graham Dr., Pierrefond, Quebec, Canada

[21] Appl. No.: 408,591

[22] Filed: Aug. 16, 1982

[30] Foreign Application Priority Data

Aug. 17, 1981 [CA] Canada ..... 383992

[51] Int. Cl.[3] ..... A63C 9/10

[52] U.S. Cl. ..... 280/615

[58] Field of Search ..... 280/615, 614, 623, 630, 280/635; 36/117

[56] References Cited

U.S. PATENT DOCUMENTS

| | | | |
|---|---|---|---|
| 4,004,823 | 1/1977 | Pyzel et al. | 280/615 |
| 4,082,312 | 4/1978 | Johnson | 280/615 |
| 4,146,247 | 3/1979 | Johansson et al. | 280/615 |
| 4,148,502 | 4/1979 | Stanfer et al. | 280/615 |

FOREIGN PATENT DOCUMENTS

| | | | |
|---|---|---|---|
| 47443 | 5/1909 | Switzerland | 280/615 |

*Primary Examiner*—David M. Mitchell

*Attorney, Agent, or Firm*—George A. Seaby

[57] ABSTRACT

A toe binding for a cross country ski includes a rectangular plastic block for mounting on the ski, with a T-shaped groove in the top of the block for receiving a similarly shaped toe piece. One end of the toe piece is molded into or otherwise permanently attached to the sole of a cross country ski boot, the T-shaped front end of the toe piece extending forwardly. The toe piece is retained in the block by pins slidably mounted in the block for intersecting the groove above the toe piece. The pins are biased across the groove by a leaf spring, and can be moved out of the groove by a handle connected to the spring and pivotally connected to the block by a lever, the handle having a notch for receiving the tip of a ski pole, whereby the handle, lever, spring and pins can be moved.

5 Claims, 3 Drawing Figures

TOE BINDING FOR SKIS

BACKGROUND OF THE INVENTION

1. Field of the Invention

This invention relates to a toe binding for skis and in particular to a cross country ski binding.

2. Discussion of the Prior Art

The device of the present invention is specifically designed to retain the toe portion of a cross country ski boot or shoe, (hereinafter referred to simply as a boot) which is provided with a toe piece for engaging the binding. Devices of this type are described, for example in U.S. Pat. Nos. 2,991,086, issued to J. B. Woodward on July 4, 1961; 2,994,543, issued to H. Hvam on Aug. 1, 1961; 3,603,606, issued to N. Eie on Sept. 7, 1971; 4,004,823, issued to E. D. Pyzel et al on Jan. 25, 1977; 4,082,312, issued to L. B. Johnson on Apr. 4, 1978; 4,129,319, issued to H. Strohmeier on Dec. 12, 1978; 4,146,247, issued to C. Johansson et al on Mar. 27, 1979; 4,184,696, issued to R. J. Settembre on Jan. 22, 1980, and 4,219,216, issued to R. J. Settembre on Aug. 26, 1980.

Most of the devices disclosed by the above-mentioned patents are somewhat complicated, including a large number of parts. Thus, the bindings are believed to be unnecessarily susceptible to problems due to wear, misalignment or damage to one or more elements of the bindings. Others of the bindings include exposed helical springs, which can readily be clogged by snow and ice, making operation of the binding difficult. In any event, as in many fields of invention, it is the opinion of the present inventors that there is definite room for improvement in the ski binding art.

The object of the present invention is to alleviate the difficulties and problems envisaged with prior art bindings by providing a relatively simple, easily operated toe binding for skis.

GENERAL DESCRIPTION OF THE INVENTION

Accordingly, the present invention provides a toe binding for use with a ski and a boot of the type including a substantially T-shaped toe piece extending forwardly from the toe end of the boot, said binding comprising a body for mounting on a ski; a substantially T-shaped groove in said body for receiving said toe piece, pin means slidable in said body for movement between a toe piece retaining position and a toe piece release position; leaf spring means connected to said body biasing said pin means toward said toe piece retaining position; and handle means connected to said spring means for moving said pin means from the toe piece retaining position to the release position, whereby the toe piece can be removed from the ski binding.

BRIEF DESCRIPTION OF THE DRAWINGS

The invention will now be described in greater detail with reference to the accompanying drawing, which illustrates a preferred embodiment of the invention, and wherein.

DESCRIPTION OF PREFERRED EMBODIMENTS

Figure 1:
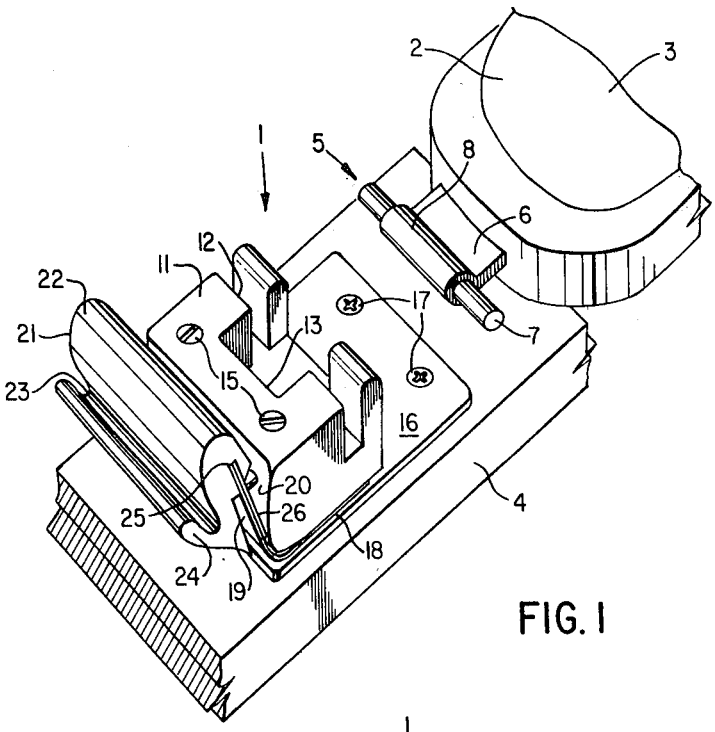
FIG. 1 is a perspective view from above of a portion of a cross country ski, the toe end of a boot and a binding in accordance with the present invention in the release or open position.

With reference to the drawing, a toe binding in accordance with the present invention which is generally indicated at 1 is intended for holding toe end 2 of a ski boot 3 on a ski 4. For such purpose, the toe end 2 of the ski boot 3 is provided with a forwardly extending, substantially T-shaped toe piece generally indicated at 5. The toe piece 5 includes a flat metal shank 6, which defines the stem of the T, and a transversely extending rod 7, which defines the top arms of the T. The rod 7 is securely mounted in a loop 8 at the outer end of the shank 6. Inner end 9 (FIG. 3) of the shank 6 is molded into the toe end of sole 10 of the ski boot 3.

The toe binding 1 includes a generally rectangular body 11, with a T-shaped groove 12 in the top, rear end thereof for receiving the top piece 5. A rectangular recess 13 is provided behind the groove 12 for receiving a screw 14 for fastening the body 11 on the ski 4. Screws 15 are also used to connect the body 11 to the ski 4. The body 11 is formed of hard plastic. A rectangular, metal plate 16 is interposed between the body 11 and the ski 4. The plate 16 extends rearwardly (towards the rear of the skis) beyond the rear end of the body 11. The rear end of the plate 16 is secured to the ski 4 by screws 17.

A steel leaf spring 18 is sandwiched between the body 11 and the plate 16. The spring 18 is generally L-shaped, arm 19 thereof curving upwardly and rearwardly in the relaxed condition around similarly curved front end 20 of the body 11. A hard plastic handle 21 is provided at the top of the arm 19 of the spring 18 for moving the end 19 toward and away from the front end 20 of the body 11. The handle 21 is generally V-shaped, with a large head 22 defining one arm thereof and a deep notch 23 between the arms 22 and 24. A groove 25 in the bottom of the head 22 receives the top end of the arm 19 of the spring 18.

The top end of a lever 26 defined by a rectangular metal plate is also securely mounted in the groove 25. The lever 26 is sandwiched between the arm 19 of the spring 18 and the front end 20 of the body 11. The handle 21 and the lever 26 extend across the entire width of the body 11. A pair of pins 27, which are the arms of a generally U-shaped rod 28 are slidably mounted in the body 11 for movement between an extended, toe piece engaging position (FIGS. 2 and 3) and a retracted, toe piece release position (FIG. 1). Bight or end 29 of the rod 28 is located in front of the lever 26 and the arm 19 of the spring 18, the pins 27 extending through such lever and spring.

Figure 2:
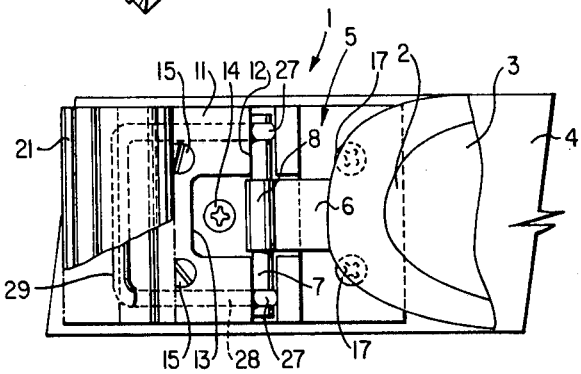
FIG. 2 is a partly sectioned, plan view of the ski, boot and binding of FIG. 1 in the boot retaining position.
Figure 3:
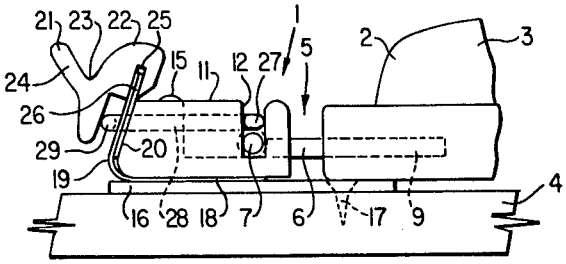
FIG. 3 is a side elevation view of the ski, boot and binding of FIGS. 1 and 2 in the boot retaining position.

In the relaxed condition of the binding, the free ends of the pins 27 extend across the arms of the T-shaped groove 12 near the top of such groove. In order to open the binding, pressure (for example, using the tip of a ski pole) is applied to the handle 21 in the area of the bottom of the notch 23. The pressure causes the lever 26 to pivot around its bottom edge, pushing the handle 21 and the arm 19 of the spring 18 outwardly away from the front surface 20 of the body 11. Such movement of the handle 21, lever 26 and spring 18 causes the pins 27 to retract from the extended position (FIGS. 2 and 3) to the retracted position (FIG. 1). In such retracted position, the rod 7 of the toe piece 5 can be inserted into the groove 12. The handle 21 is then released, and the spring 18 returns the pins 27 to the closed, toe piece retaining position (FIGS. 2 and 3). Of course, the toe piece is released by again applying sufficient pressure to the handle 21 to release the pins 27.

The lever 26 merely facilitates bending of the spring 18, i.e. movement of the front end 19 of the spring away from the front end 20 of the body 11. It will be appreciated that while the lever 26 is preferably present in the binding, such lever can be omitted.

An important feature of the present invention is that the binding is a so-called step-in type, i.e. it is merely necessary for the skier to press the rod 7 of the toe piece 5 against the pins 27 to open binding. It will be noted that the free ends of the pins 27 are rounded. When the rod 7 is pressed against the pins 27, the pins are forced rearwardly against the bias of the spring 18, permitting entry of the rod 7 fully into the groove 12. As soon as the rod 7 has passed the pins 27, the spring 18 returns the pins to the toe piece retaining position (FIGS. 2 and 3). The toe piece is released by pressing downwardly on the handle 21.

I claim:

1. A toe binding for use with a ski and a boot of the type including a substantially T-shaped toe piece extending forwardly from the toe end of the boot, said binding comprising a body for mounting on a ski; a substantially T-shaped groove in said body for receiving said toe piece; pin means slidable in said body for movement between a toe piece retaining position and a toe piece release position; spring means connected to said body biasing said pin means toward said toe piece retaining position; and handle means connected to said spring means for moving said pin means from the toe piece retaining position to the release position, whereby the toe piece can be inserted into or removed from the ski binding.

2. A toe binding according to claim 1, including lever means between said spring means and said body for facilitating movement of said pin means.

3. A toe binding according to claim 1 or 2, wherein said body is substantially rectangular, said groove being near one end thereof, said spring means extending outwardly and upwardly from the other end of said body.

4. A toe binding for use with a ski and a boot of the type including a substantially T-shaped toe piece extending forwardly from the toe end of the boot, said binding comprising a substantially rectangular body for mounting on a ski; a substantially T-shaped groove in one end of said body for receiving said toe piece; pin means slidable in said body for movement between a toe piece retaining position intersecting said groove and a toe piece release position; leaf spring means connected to the other end of said body biasing said pin means toward said toe piece retaining position; and handle means connected to said leaf spring means for moving said pin means from the toe piece retaining position to the release position, whereby the toe piece can be inserted into or removed from the binding.

5. A toe binding according to claim 4, wherein said leaf spring means extends outwardly and upwardly from said other end of said body; lever means between said leaf spring means and said body; said pin means including a substantially U-shaped rod, each arm defining a pin; the bight of the rod being outside of said leaf spring means and lever means, and each pin extending through said leaf spring means, lever means and body.

* * * * *